US006863264B2

(12) United States Patent
Johansson et al.

(10) Patent No.: US 6,863,264 B2
(45) Date of Patent: Mar. 8, 2005

(54) CABLE BARRIER AND METHOD OF MOUNTING SAME

(75) Inventors: Roland Johansson, Hölö (SE); Johnny Mattsson, Mariestad (SE)

(73) Assignee: Vagverket, Borlange (SE)

( * ) Notice: Subject to any disclaimer, the term of this patent is extended or adjusted under 35 U.S.C. 154(b) by 0 days.

(21) Appl. No.: 10/399,860

(22) PCT Filed: Oct. 26, 2001

(86) PCT No.: PCT/SE01/02354

§ 371 (c)(1),
(2), (4) Date: Apr. 28, 2003

(87) PCT Pub. No.: WO02/35009

PCT Pub. Date: May 2, 2002

(65) Prior Publication Data

US 2004/0041140 A1 Mar. 4, 2004

(30) Foreign Application Priority Data

Oct. 27, 2000 (SE) ..... 0003917

(51) Int. Cl.[7] ..... E01F 15/00
(52) U.S. Cl. ..... 256/13.1; 256/32
(58) Field of Search ..... 256/13.1, 32, 33, 256/48

(56) References Cited

U.S. PATENT DOCUMENTS

| | | | | | |
|---|---|---|---|---|---|
| 383,296 | A | * | 5/1888 | Husselman | 256/32 |
| 429,038 | A | * | 5/1890 | Kerr, Sr. | 256/32 |
| 962,632 | A | * | 6/1910 | Frost | 256/32 |
| 1,499,933 | A | * | 7/1924 | Jones | 256/48 |
| 1,828,349 | A | | 10/1931 | Williams | |
| 1,857,435 | A | | 5/1932 | Cole | |
| 1,860,615 | A | * | 5/1932 | Kahn | 256/13.1 |
| 2,026,259 | A | | 12/1935 | Tarbox | |
| 5,039,066 | A | | 8/1991 | Stacey | |
| 6,065,738 | A | | 5/2000 | Pearce et al. | |

OTHER PUBLICATIONS

"I Grund Och Botten," *Svensk Vägförening*, 70:2 (1983).

* cited by examiner

*Primary Examiner*—John R. Cottingham
(74) *Attorney, Agent, or Firm*—Jacobson Holman PLLC

(57) ABSTRACT

A safety barrier for use on roads, the barrier including wires, wire posts and a wire anchor with a ground anchoring structure having anchoring wings that are pressed or driven down into the ground and a wire anchoring component with a locking device for securing the wires. A method of mounting the safety barrier by the wire anchor being pressed or driven down into the ground is also provided.

20 Claims, 4 Drawing Sheets

CABLE BARRIER AND METHOD OF MOUNTING SAME

This is a nationalization of PCT/SE01/02354, filed Oct. 26, 2001 and published in English.

The present invention relates to a steel cable barrier for roads and a method of mounting a steel cable barrier.

Road safety matters are becoming more and more important as the volume of traffic increases in society. Preventing accidents and reducing the consequences thereof are matters in which more and more people are being involved. A manner of reducing the consequences is to mount safety barriers along the roads to prevent cars from leaving the road or getting into the opposite roadway. On today's motorways where the lanes are in most cases separated by a ditch only, or on arterial roads where there is nothing to separate the lanes, there is a risk that a car gets on the wrong side of the road with the ensuing serious injuries and vehicle damage.

Safety barriers have been in use for a long time. Above all barriers with horizontal beams have been used to prevent vehicles from slipping off the road in particularly exposed places, such as bridges and viaducts, or as a central barrier on motorways. Safety barriers of this type, however, suffer from a number of drawbacks. In addition to being expensive they are in the first place intended to prevent a vehicle from leaving the road and they are thus heavy and can affect vehicles and passengers to an unnecessarily great extent.

The wish to reduce injuries has resulted in steel cable barriers, also called wire barriers, being seen as a solution. The barrier functions in such manner that steel cables (wires) catch the lateral forces and cause the car to follow the safety barrier until it stops or until the driver himself can resume control of his car and make it slow down.

Steel cable barriers and methods of mounting the same are disclosed in, inter alia, U.S. Pat. No. 6,065,738 A and U.S. Pat. No. 5,039,066. The first US document discloses how a wire is fixed to a concrete foundation by means of a safety device that releases the wire if a car should be clamped between the wire and the road. The second document discloses posts with fixing means for the wire and concrete foundations for the posts.

A problem of prior-art steel cable barriers is that extensive work is necessary for mounting. Wire anchoring foundations and post foundations are made of concrete and, thus, large and heavy, which requires a great conveying and lifting capacity. Moreover, they must be buried in the ground, thus necessitating extensive digging work, causing traffic jam and putting road-workers in jeopardy for a long time.

Another problem that arises in digging adjacent to or in a road is that subsidence arises some time after the road has been repaired and provided with a new paving. This means that road-workers have to apply a new paving once more. Since great digging operations interfere with the road to a great extent, the damage owing to subsidence will also be great, requiring the use of a plurality of vehicles with road-workers for repair. Taken together, this causes traffic jam and costs a lot of money.

One more problem is that post foundations of concrete have been found to come loose from the ground in case of collision. Except that this involves extra work in burying new foundations and repairing the ground, the foundation may also cause severe damage when being pulled up from the ground.

The object of the present invention is to provide a steel cable barrier that solves the above problems. According to the invention this is achieved by a steel cable barrier, comprising wires, wire posts and a wire anchor, which has a ground anchoring means with anchoring wings which are pressed or driven down into the ground, and a method of mounting a steel cable barrier by a wire anchor being pressed or driven into the ground.

The invention will now be described in more detail with reference to the accompanying drawings.

Figure 1:
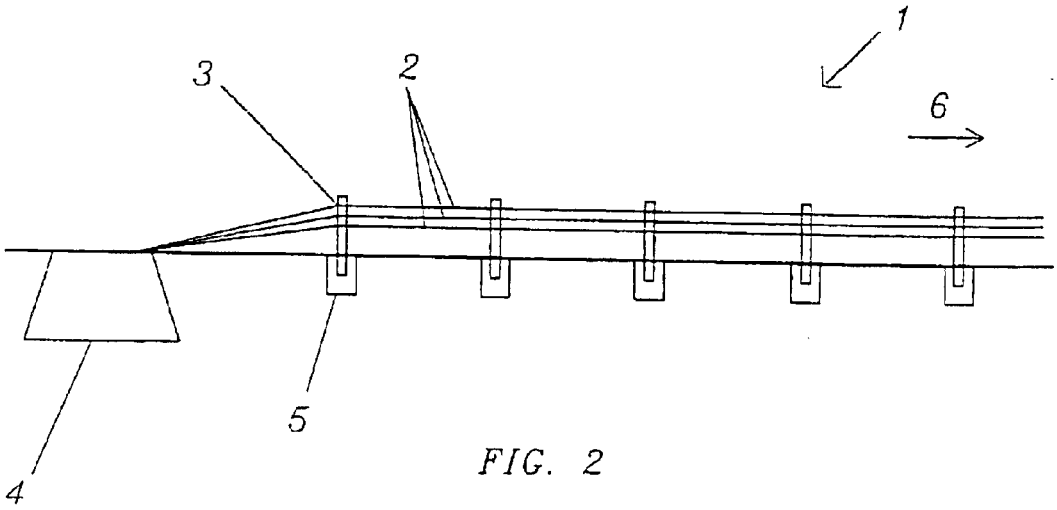
FIG. 1 shows a steel cable barrier according to prior art.
Figure 2:
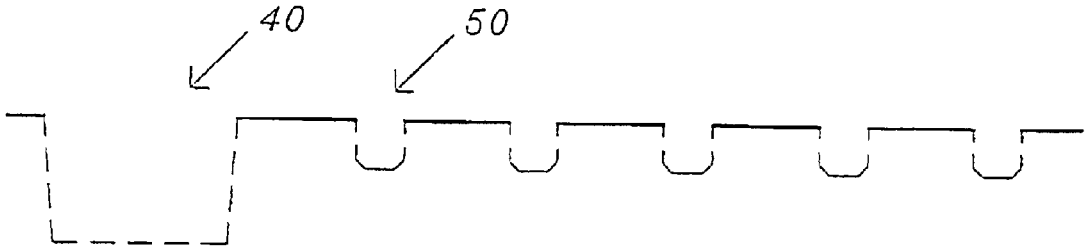
FIG. 2 shows ground work that is necessary with prior art.

FIG. 1 shows a steel cable barrier (1) according to prior art. The barrier (1) has a number of wires (2) which are supported by wire posts (3). At each end of the barrier (1), the wire (2) is anchored in the around by means of a wire anchoring foundation (4). The foundation (4) is in most cases a prefabricated concrete block or a block cast in situ. The wire posts (3) are also anchored in the ground by means of post foundations (5) of concrete. A wire anchoring foundation (4) weighs between 2000 and 4000 kg and a post foundation (5) between 30 and 100 kg. FIG. 2 shows that the ground work that is necessary to bury the wire anchoring foundation (4) and the post foundation (5) is extensive and causes great damage to the ground and the road.

Figure 3:
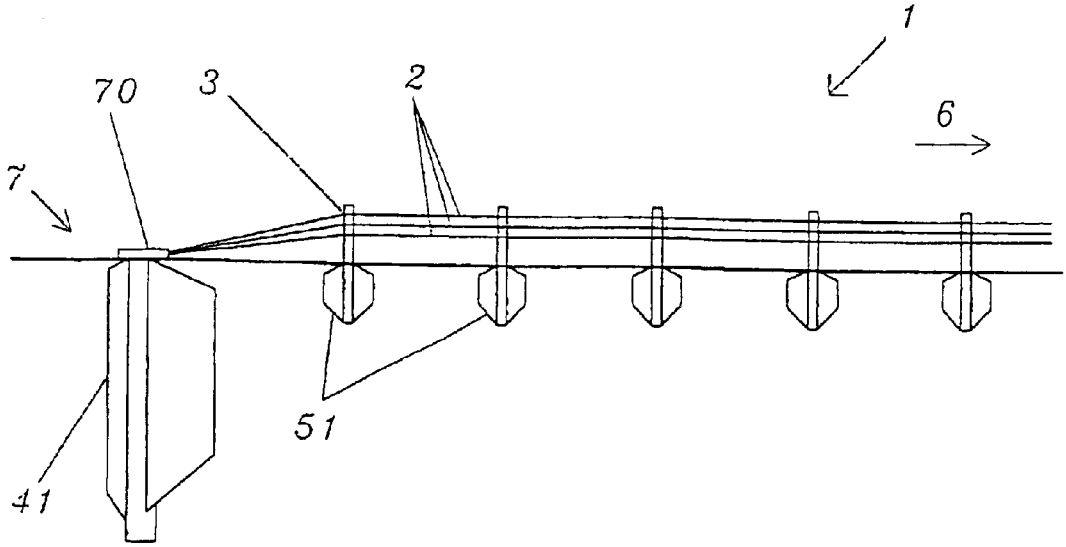
FIG. 3 shows a steel cable barrier according to the invention.
Figure 4:
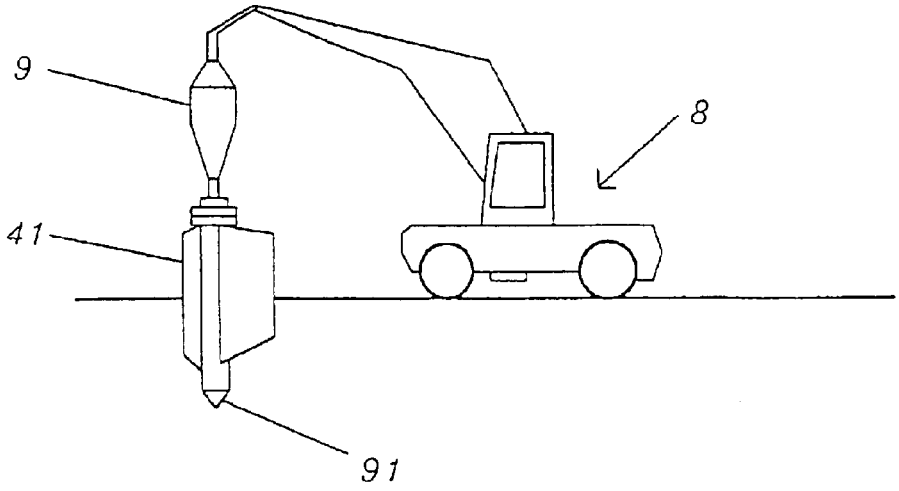
FIG. 4 shows ground work with the steel cable barrier according to the invention.
Figure 5:
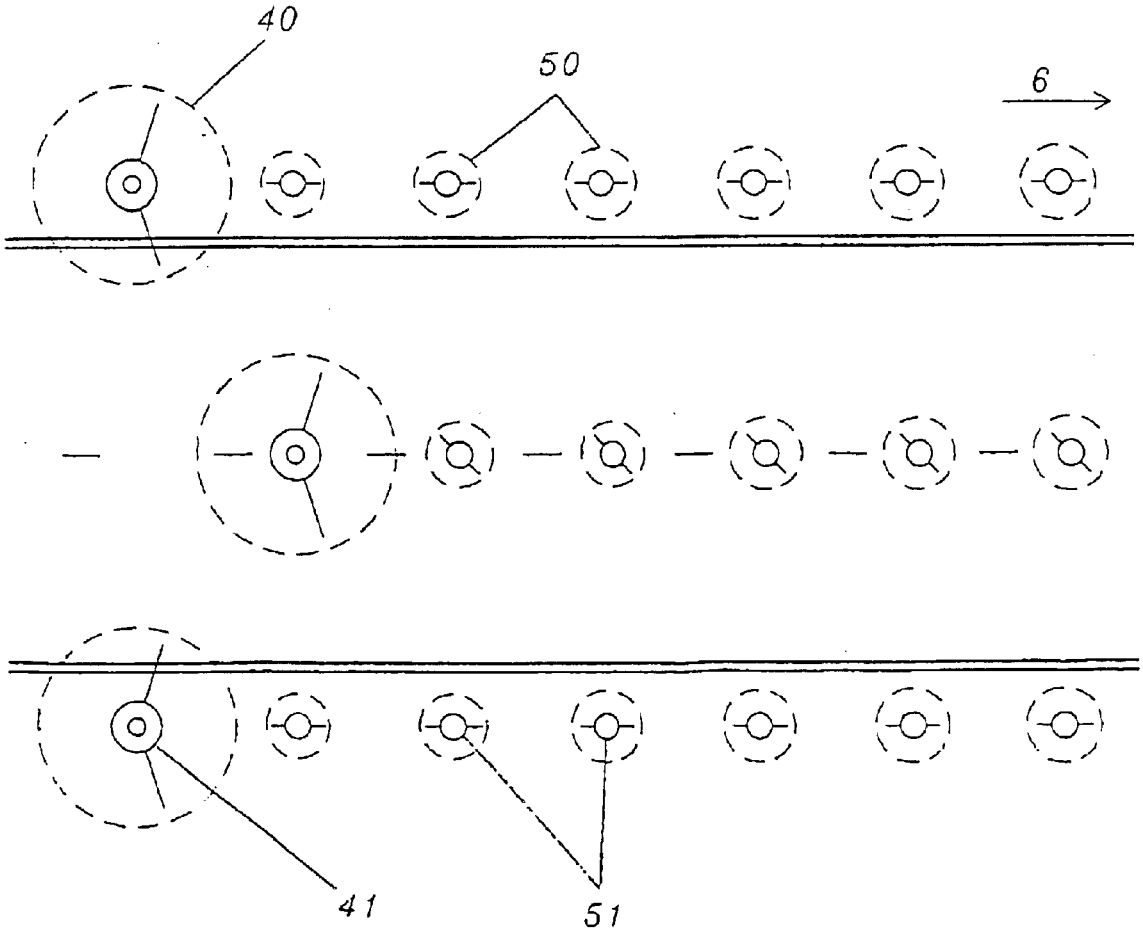
FIG. 5 is a top plan view of a road.

FIG. 3 shows a steel cable barrier (1) according to the invention. The barrier (1) has a number of steel wires (2) which are supported by wire posts (3). At each end of the barrier (1), the wire (2) is anchored in the ground, by ground here being meant also road, road embankment and other areas round a road, by means of a wire anchor (7). The wire anchor (7) is pressed or driven into the ground or road, which means that no digging work is necessary. FIG. 4 shows flow a working vehicle with a percussion hammer (9) drives a ground anchoring means (41) belonging to a wire anchor (7) into the ground. In order not to need to dig a hole for the wire post foundations (5), a post anchor (51) is used which is also driven into the ground. The post anchor can be of different types. FIG. 5 showing the traces of a ground anchor with two wings, but it is also possible to use an anchor with three wings (FIG. 3) or more. FIG. 5 also shows how the wings of the ground anchor can be arranged. Ground anchors (51) which are driven into the ground along the road have their wings parallel with the road, and ground anchors that are driven into the centre of the road have their wings rotated through 45 degrees to the direction of the road.

The wire post (3) carries the wire (2) and withstands vertical forces whereas application of a load in the horizontal direction, for instance a collision, results in the wire post (3) being folded without the anchor (5) being affected. This is achieved by the wire post (3) being made of a material of such a thickness as to make it yield in case of a collision, by arranging weakened portions at the root of the post or the like.

FIG. 5 shows the difference in damage to the ground and the road when mounting a steel cable barrier along a road and in the centre of a road. According to prior art, a plurality of large holes (40) for the wire anchoring foundations must be digged as must also a large number of small holes (50) for the foundations of the wire posts. Using wire anchoring and anchoring of wire posts according to the invention, only long narrow holes arise after the anchoring wings. Holes that are easy to mend and that do not cause any damage to underlying layers in the ground and the road that may give rise to future subsidence.

Figure 6:
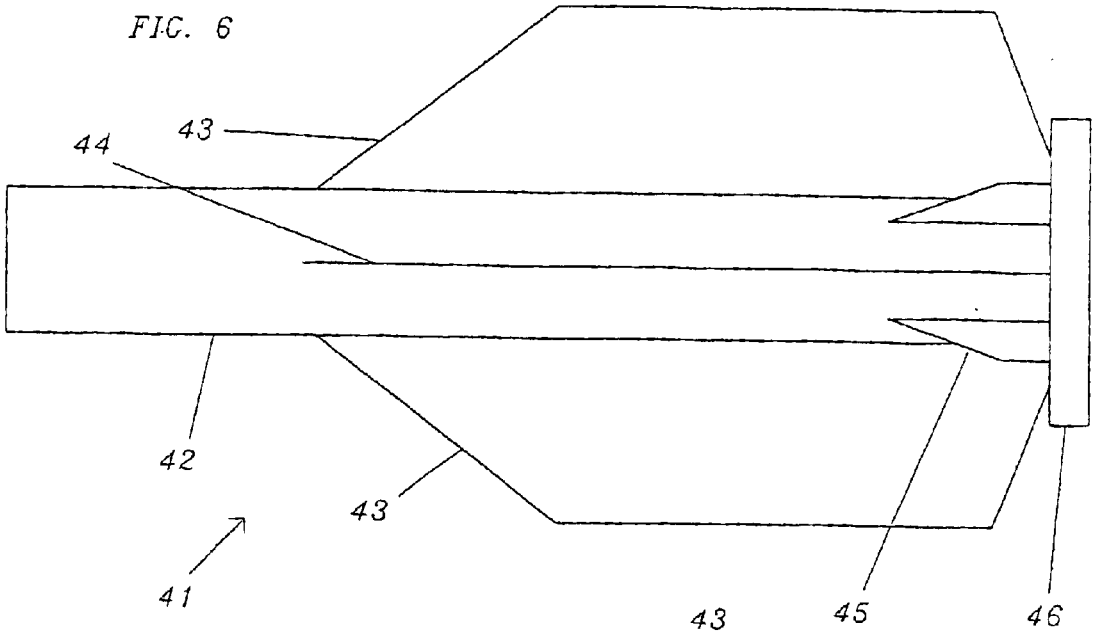
FIG. 6 illustrates a ground anchoring means according to the invention.
Figure 7:
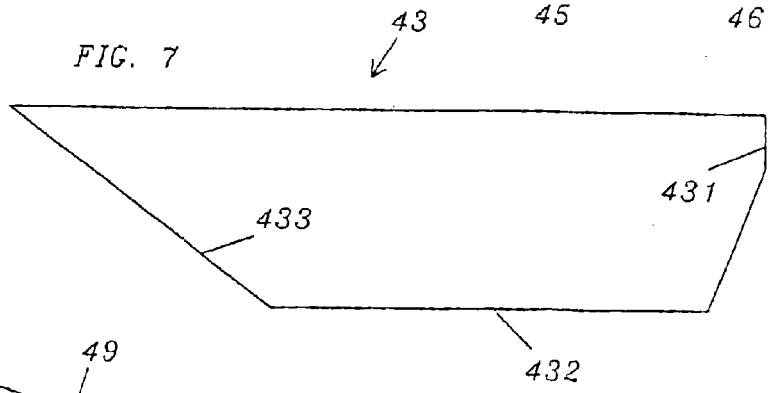
FIG. 7 illustrates a wing of a ground anchoring means.

FIG. 6 shows an embodiment of a ground anchoring means (41) according to the invention. The ground anchoring means comprises a tube (42), two anchoring wings (43), a reinforcing wing (44), two supporting wings (45) and a top plate (46). An example of an anchoring wing is illustrated in FIG. 7. The anchoring wing (43) has an upper horizontal part (431) supporting the top plate (46), a pointed side (433) and a vertical side (432). Depending on the ground conditions, the properties and number of the anchoring wing may need to be changed in many different ways, e.g. more pointed-more blunt, wider-narrower, longer-shorter or three-four wings. To support the top plate (46), use is made of two supporting wings (45) and the anchoring wings (43). The top plate (46) has a centre hole of the same size as the outer diameter of the tube (42) and encloses the outermost end of the tube (42). The top plate (46) is conveniently welded to the tube (42) and to the supporting and anchoring wings (43, 45).

Figure 8:
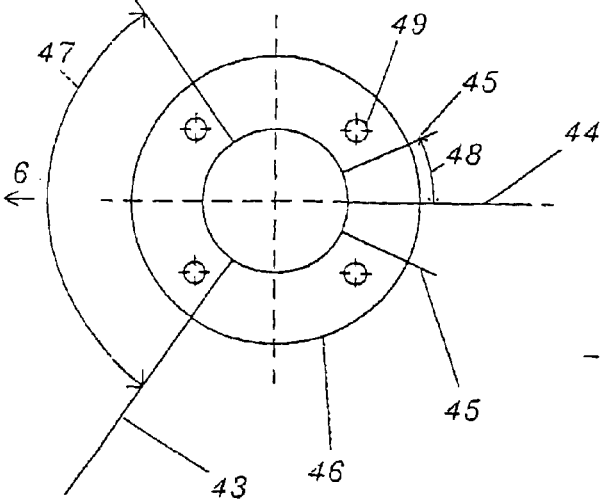
FIG. 8 is a bottom view of the around anchoring means according to the invention.
Figure 9:
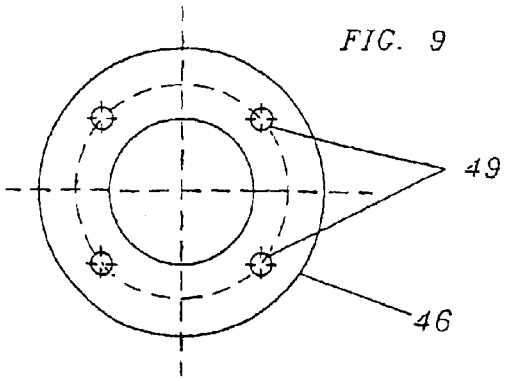
FIG. 9 illustrates a top plate for the ground anchoring means.

FIG. 8 shows the ground anchoring means seen from below. The two anchoring wings (42) are symmetrically arranged and directed towards the wire direction (6) at an angle (47) of 110 degrees between them. Depending on the ground conditions etc, ground anchoring means (41) with the wings (43) placed at a different angle (47) may have to be used. However, the angle (47) should not be greater than 180 degrees. FIG. 8 also shows the two supporting wings (45) and the reinforcing wing (44) arranged away from the wire direction (6). The supporting wings (45) are symmetrically arranged at an angle (48) to the reinforcing wing (44). The angle (48) is 30 degrees but may be varied depending on the angle (47) of the anchoring wings so as to obtain a suitable support for the top plate (46). The reinforcing wing (44) is arranged along, the tube (42) to prevent the tube from being bent when exposed to strains. When a vehicle collides with the barrier (1), the wires (2) are subjected to great forces which are transferred down in the wire anchor (7). For the wire anchor to be able to take up the forces, it is important that the forces affect the ground anchoring means (41) in the correct direction. Ground anchoring means of this type are relatively poor at taking up vertical forces striving to pull out the anchor. The same applies if the ground anchoring means can be pulled up/made to climb up obliquely, for instance at the angle at which the wire extends to the wire anchor. This occurs if the tube (42) bends and must be prevented. A simple way of preventing this is to arrange one or more reinforcing wings (44) on the pipe (42) oil the side opposite to the side where the wires (2) are inserted.

Figure 10:
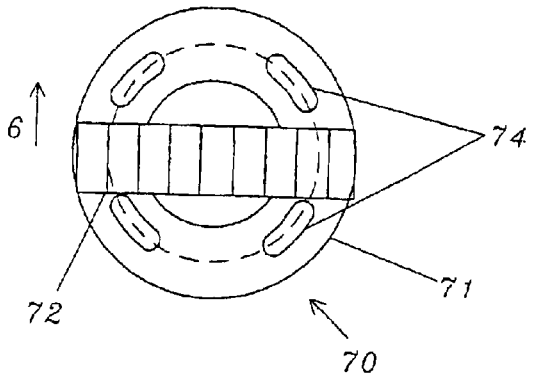
FIG. 10 is a top plan view of a wire anchoring means.

FIG. 10 illustrates a wire anchoring means (70) comprising a plate (71) with elongate holes (74) and a cam part (72). The wire anchoring means (70) is mounted on the top plate (46) by means of an adjustable attachment, here shown as threaded holes (49) in the top plate (46) and elongate holes (74) in the plate (71). Bolts are passed down through the elongate holes (74) and fastened in the threaded holes (49). The elongate holes (74) make it possible to adjust the wire anchoring means so that the cam part (72) is perpendicular to the wire direction (6) even if the ground anchoring means (41) should have turned while being driven into the ground.

Figure 11:
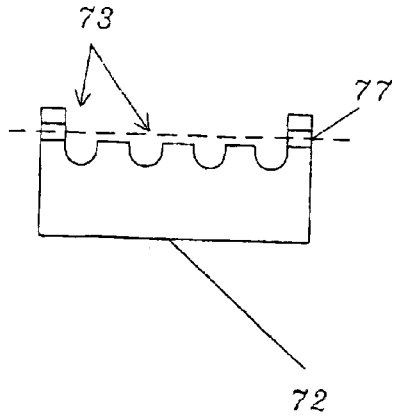
FIG. 11 shows a wire anchoring cam.
Figure 13:
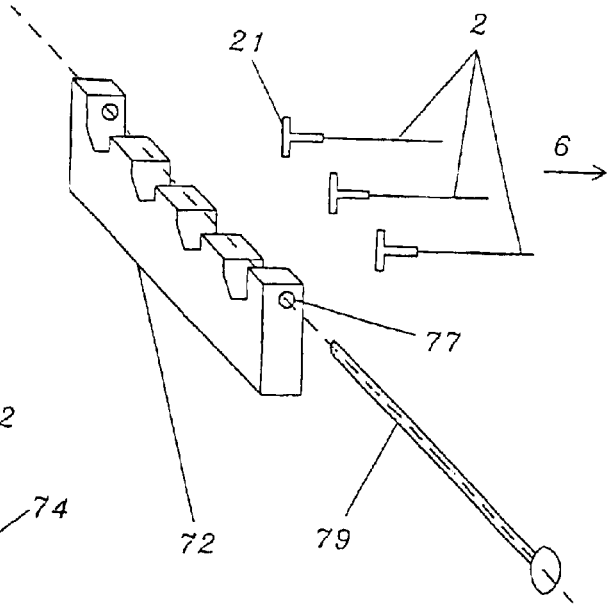
FIG. 13 shows a wire anchoring cam with a locking device.

FIGS. 11 and 13 show the cam part (72) with recesses (73) and a locking device in the form of holes (77) and a bolt (79). The wires (2) have at their ends an end fitting (21) which fits into the recesses (73) on the cam part (72). When the end fittings have been arranged in the cam part (72), they are locked by the bolt being passed through the holes (77). In order to further tighten the wires (2), turnbuckles are arranged on the wires.

Figure 12:
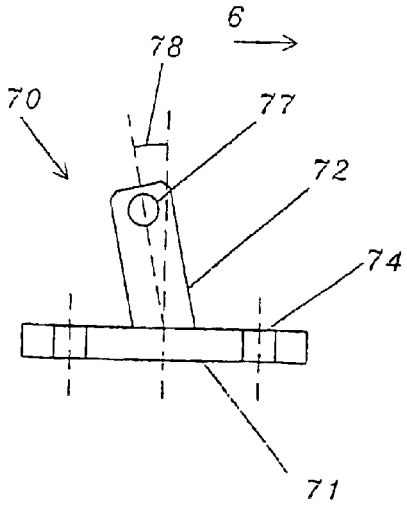
FIG. 12 is a side view of the wire anchoring means.

FIG. 12 shows how the cam part (72) is arranged on the plate (74). The cam part (72) is inclined from the wire direction (6) at an angle (78) that depends on how the wires (2) come down. Suitably the wires should extend at an angle of about 90 degrees to the cam part. According to the invention, an angle (78) of 5–20 degrees, and most advantageously about 8 degrees, is preferred, which results in a distance between the wire anchor and the first wire post as well as load take-up that follow current standards.

There is a risk that the wire anchor (7) is subjected to external effects that may damage the wire attachment and if it comes to the worst, loose the wires (2) and make the entire steel cable barrier (1) ineffective. The external effects can be, for instance, in the form of a road grader or a snowplough. To prevent this, a safety cover can be arranged on the wire anchoring means (7) which lets the snowplough pass over it, or a safety cover can be arranged round the wire anchor (7) to prevent the plough from coming close.

What is claimed is:

1. A safety barrier for roads, comprising one or more wires, one or more wire posts, and at least one wire anchor in the ground, said wire anchor including a ground anchoring structure with anchoring wings which are pressed or driven down into the ground, and a wire anchoring component having a fixing cam with a recess for an end fitting and a locking device which prevents said end fitting from leaving said recess.

2. The safety barrier as claimed in claim 1, wherein the wire posts are made with a thickness which is yieldable when being hit.

3. The safety barrier as claimed in claim 1, wherein the wire anchoring component is mounted on the ground anchoring structure.

4. The safety barrier as claimed in claim 1, wherein the ground anchoring structure includes a tube with two anchoring wings symmetrically arranged towards the wire direction at an angle of less than 180 degrees between them.

5. The safety barrier as claimed in claim 4, wherein the angle is 80–140 degrees.

6. The safety barrier as claimed in claim 5, wherein the angle is 110 degrees.

7. The safety barrier as claimed in claim 4, wherein a reinforcing wing is arranged along a length of the tube, parallel with the wire direction but on the opposite side of the tube.

8. The safety barrier as claimed in claim 1, wherein the ground anchoring structure includes a tube with a top plate arranged round the tube and having an attachment for said wire anchoring component.

9. The safety barrier as claimed in claim 8, wherein the wire anchoring component includes a plate supporting said fixing cam.

10. The safety barrier as claimed in claim 9, wherein the fixing cam is arranged upright from the plate at an angle of 5–20 degrees from vertical, inclined from the wire direction.

11. The safety barrier as claimed in claim 10, wherein the angle is 5–10 degrees.

12. The safety barrier as claimed in claim 8, wherein the wire anchoring component has a safety cover protecting it from being hit by a vehicle.

13. The safety barrier as claimed in claim 12, wherein the safety cover is arranged round the wire anchor.

14. A method of mounting a safety barrier along a road, said safety barrier including at least one wire, at least one wire post and at least one wire anchor having a ground anchoring structure, said method comprising the steps of:

pressing or driving the ground anchoring structure of said wire anchor down into the ground/road;

anchoring the wire in the wire anchor by mounting the wire in a wire anchoring component mounted on said ground anchoring structure, said wire anchoring component having a recess for receiving an end fitting of said wire; and locking the wire in said recess of said wire anchoring component with a locking device that prevents said end fitting from leaving said recess.

15. The method as claimed in claim 14, wherein said ground anchoring structure includes a tube, said method further comprising the step of driving the ground anchoring structure down into the ground using a percussion hammer, a point of the percussion hammer being passed through said tube and pressing away earth to give place for the tube.

16. The method as claimed in claim 14, further comprising anchoring the wire post with a ground foundation provided with wings, said ground foundation being pressed or driven down into the ground/road.

17. The safety barrier as claimed in claim 1, wherein said fixing cam includes a plurality of recesses for a plurality of end fittings, respectively, said locking device preventing said plurality of end fittings from leaving said plurality of recesses.

18. A safety barrier for roads, comprising a wire with an end fitting, a wire post, and a wire anchor, said wire anchor including a ground anchoring structure and a wire anchoring component having a fixing cam with a recess for said end fitting and a locking device which prevents said end fitting from leaving said recess.

19. The safety barrier as claimed in claim 18, wherein said barrier includes a plurality of wires, each wire having an end fitting, said fixing cam including a plurality of recesses for said plurality of end fittings, respectively, and said locking device preventing said plurality of end fittings from leaving said plurality of recesses.

20. The safety barrier as claimed in claim 18, wherein the wire anchoring component includes a plate supporting said fixing cam, said fixing cam being arranged upright and inclined from said plate.

* * * * *